United States Patent [19]

Gilbert

[11] 3,950,899

[45] Apr. 20, 1976

[54] BLADE HOLDER FOR USE WHEN SHARPENING

[75] Inventor: Richard Gilbert, Sheffield, England

[73] Assignee: Stanley Tools Limited, Sheffield, England

[22] Filed: May 23, 1974

[21] Appl. No.: 472,616

[30] Foreign Application Priority Data

June 1, 1973 United Kingdom ..... 26353/73

[52] U.S. Cl. ..... 51/221 R

[51] Int. Cl.[2] ..... B24B 19/00

[58] Field of Search ..... 51/151, 157, 158, 217 P, 51/217 R, 217 A, 211 R, 211 H, 221 BS, 221 R; 30/293

[56] References Cited

UNITED STATES PATENTS

| | | | |
|---|---|---|---|
| 107,757 | 9/1870 | Callahan | 145/5 R |
| 1,026,623 | 5/1912 | Caswell | 51/158 |
| 1,440,649 | 1/1923 | Tvedt | 30/293 UX |
| 1,586,646 | 6/1926 | Blevin | 30/293 X |
| 2,128,591 | 8/1938 | McGill | 51/158 |
| 2,346,300 | 4/1944 | Guy | 51/217 P |
| 2,644,279 | 7/1953 | Stankovich | 51/157 |

FOREIGN PATENTS OR APPLICATIONS

| | | | |
|---|---|---|---|
| 215,818 | 5/1924 | United Kingdom | 51/158 |

*Primary Examiner*—Harold D. Whitehead
*Attorney, Agent, or Firm*—Prutzman, Hayes, Kalb & Chilton

[57] ABSTRACT

A blade holder, for use when sharpening and honing a blade, to hold the blade at a fixed angle to the abrasive surface, comprises a frame, one or more rollers and clamp. The frame has a front plate, against the inside surface of which is clamped the front face of the blade. Since the blade's sharp edge is between its front face and its relatively narrow underneath face, (which extends obliquely to the thickness of the blade), the location of the blade's front face by the frame's front plate enables location of the sharp edge irrespective of whether the blade has parallel faces and irrespective of how thick the blade is. The roller is mounted on a shaft at the back of the frame. One or more clamping screws extend transversely of the shaft axis through one or more screw-threaded holes in the shaft to engage a clamping wedge member which is slidably guided in the frame for clamping the blade to the front plate of the frame.

7 Claims, 17 Drawing Figures

BLADE HOLDER FOR USE WHEN SHARPENING

BACKGROUND OF THE INVENTION

This invention relates to a blade holder for use when sharpening and/or honing a blade.

It is an object of the invention to provide such a blade holder as will hold a blade in a predetermined orientation as the blade edge is moved over a flat abrasive surface.

SUMMARY OF THE INVENTION

According to the invention there is provided a blade holder for holding a blade at an acute angle to an abrasive surface for sharpening and honing a ground surface of the blade. The holder comprises a frame having a substantially planar blade locating portion with a front edge beyond which the blade extends and an integral roller mounting portion projecting from the locating portion in fixed relationship thereto, at least one roller mounted on the mounting portion for rotation about an axis extending parallel to the plane of the locating portion and a movable clamp mounted on the frame for clamping the blade against the locating portion. The blade locating portion of the frame is disposed at an acute angle to the plane defined by its front edge and the roller axis and is provided with a blade locating surface facing generally toward the roller axis in fixed relationship to the roller. The movable clamp is mounted on the frame in confronting relationship with the fixed blade locating surface for movement toward and away from that surface in a direction defined by the axis of the roller and the front edge for clamping a blade therebetween with the face of the blade opposite the ground surface being in intimate engagement with the planar blade locating surface. In this way the angle defined by the ground surface and opposite face of the blade is independent of the thickness of the blade and dependent only on the length of the opposite face projecting beyond the front edge of the frame.

Alternatively, a member may be placed over the abrasive surface so as to raise the height of the at least one roller relative to the abrasive surface and hence to alter the angle of the blade, for honing.

There may be for example only one roller or two rollers. If there are two rollers, the holder may comprise means for maintaining the rollers selectively either together or apart.

The clamp may comprise a slidable member operated by one screw or by two screws. If the roller is, or rollers are, rotatably mounted on a (common) shaft for rotation about said axis, the or each screw may extend through a respective screw-threaded hole in the shaft, transversely of said axis.

The holder may include a gauge or written instructions indicating the required position of the blade relative to the holder for a given angle or given angles of the blade relative to the abrasive surface.

The invention will be further described by way of examples with reference to the accompanying drawings.

IN THE DRAWINGS

FIGS. 1 and 2 comprise respectively a plan view and an underneath plan view of a holder forming a first embodiment of the invention;

FIGS. 3, 4, 5, 6, 7 and 8 comprise respectively a plan view, a side elevation, a front elevation, a rear elevation, a section on line 7—7 in FIG. 6 and a view in the direction of arrow 8 in FIG. 7 of another holder forming a second embodiment;

DESCRIPTION OF THE PREFERRED EMBODIMENTS

Figure 1:
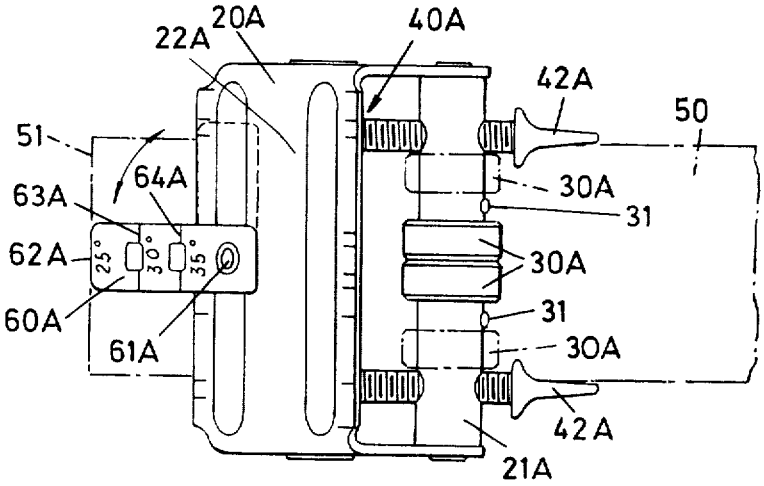
Figure 2:
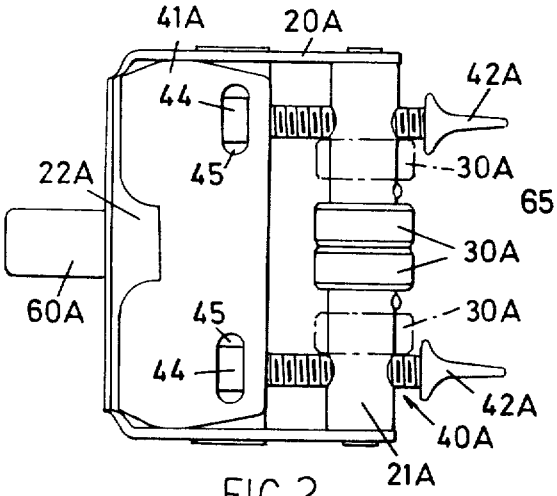
Figure 3:
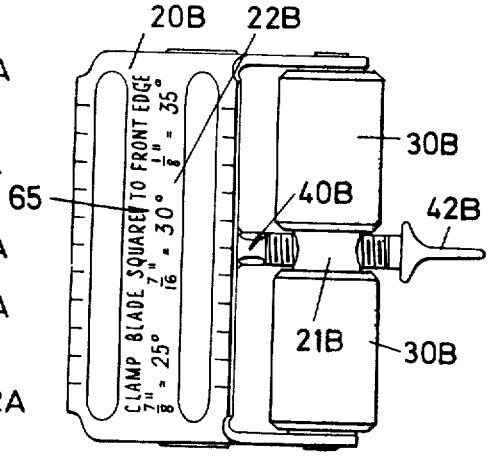
Figure 4:
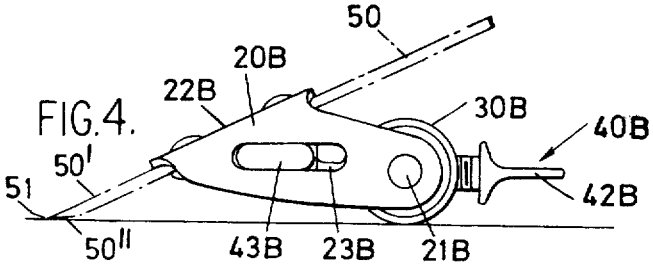
Figure 5:
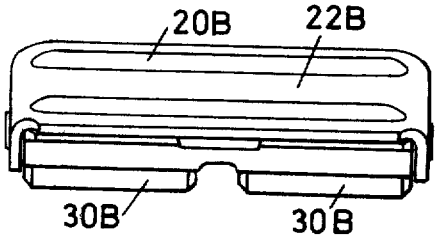
Figure 6:
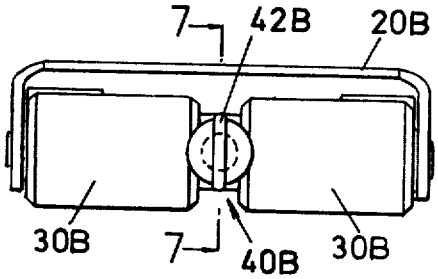

Each embodiment comprises a respective frame 20, at least one respective roller 30 mounted on or in the frame 20 for rotation about an axis, so that the holder can be made to run along a surface, (called "the first surface",) and a respective clamp 40 for clamping a blade 50 to the frame 20 so that the blade 50 can be sharpened and/or honed on an abrasive surface upon running the frame 20 along the first surface. As best shown in FIG. 4, the sharp edge 51 of the blade extends well beyond the front edge of the frame 20. (Corresponding parts of the first, second, third, fourth and fifth embodiments are respectively suffixed A, B, C, D and E in FIGS. 1 to 12 and 15 to 17 of the drawings and, where necessary, in the description).

The first, second, fourth and fifth embodiments have two rollers 30 each. In the first embodiment, two spring-loaded ball detents 31 form means for maintaining the rollers 30A selectively either together as shown in full lines or apart as shown in chain-dot lines.

In each embodiment, the clamp 40 comprises a slidable wedge member 41 operated by one or two screws 42, (one screw 42B in the second embodiment, two screws 42 each in the first, third, fourth and fifth embodiments).

In each embodiment, the frame 20 comprises a substantially planar front plate or blade locating portion 22, a pair of spaced integral shaft supporting flanges depending from the plate 22 and an integral shaft 21 on which the roller 30 is rotatably mounted. The plate 22 of the frame 20 is disposed at an acute angle to a plane defined by the axis of shaft 21 and the front edge of the frame. In all embodiments, shaft 21 can pivot about its axis in the frame 20. The screw 42 extends through a respective screw-threaded hole in the shaft 21, transversely of the axis of rotation of the roller 30, so that the wedge member 41 can be tightened up towards, or loosened away from, a front plate 22 of the frame 20 in a direction defined by the axis of the shaft 21 and the front edge of portion 22, to clamp the blade 50 therebetween or to release it, by screwing up or unscrewing the screw 42 through a shaft 21.

Figure 13:
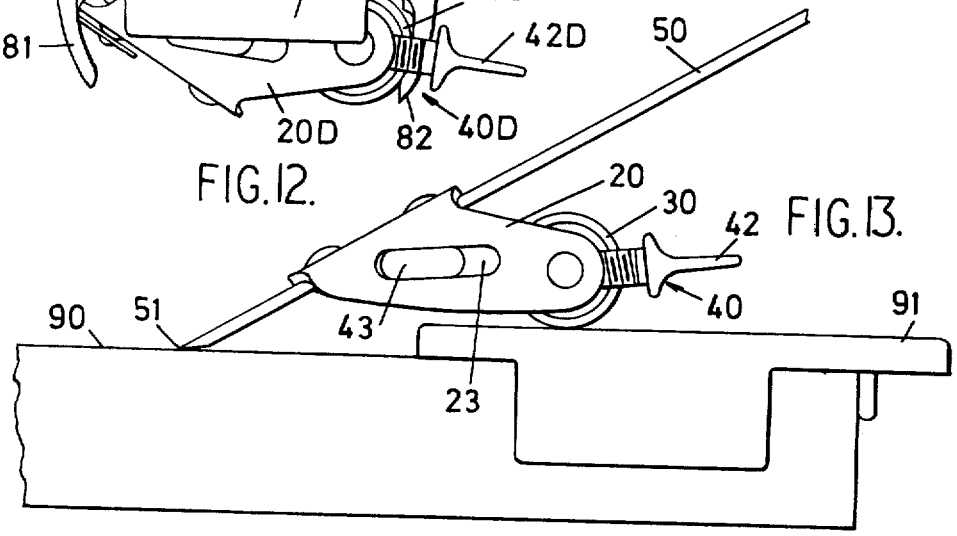
FIG. 13 is a side elevation of one of the embodiments running on a separate member placed over an abrasive block.
Figure 16:
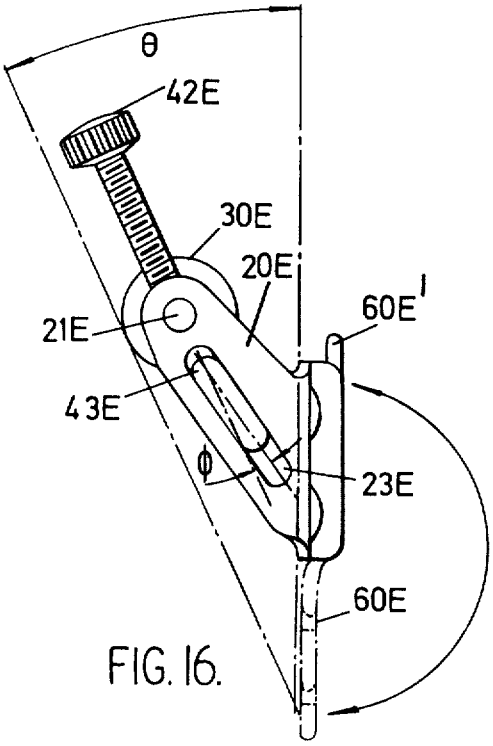
Figure 17:
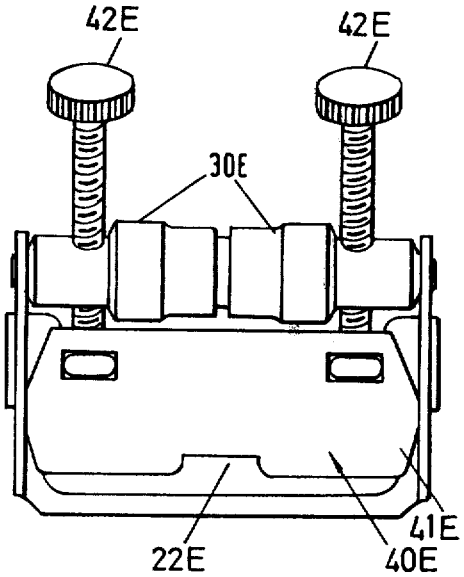

FIGS. 4, 13 and 16 show side-pieces 43 of each respective wedge member 41 slidably guided in side slots 23 of the frame 20.

In the first embodiment, nylon bushes 44 are attached to the screws 42A and located in recesses 45 in the wedge member 41A, to connect the screws 42A positively to the wedge member 41A.

Figure 7:
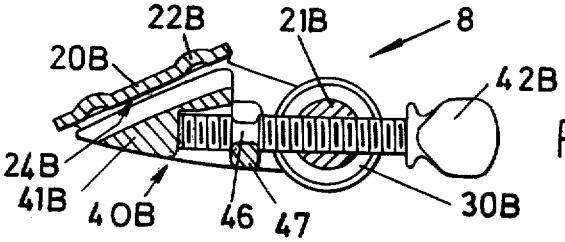
Figure 8:
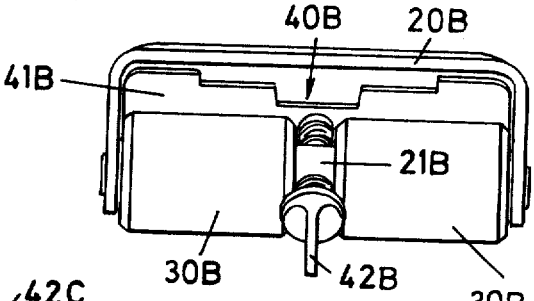
Figure 9:
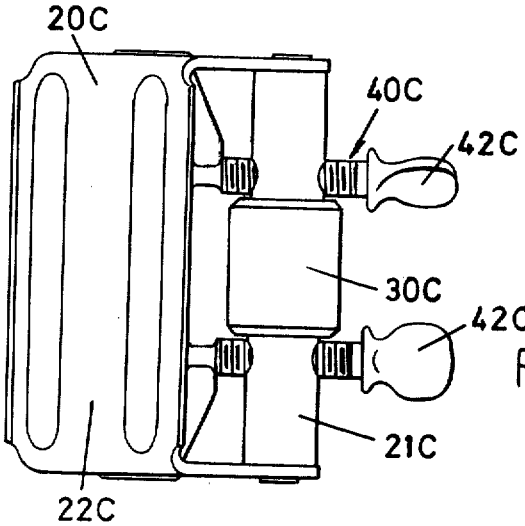
FIG. 9 is a plan view of a third embodiment.

FIG. 7 shows a different positive connection of the screw 42B to the wedge member 41B. In this case, the screw 42B has a neck 46 engaged by a crossmember 47 of the wedge member 41B.

Figure 10:
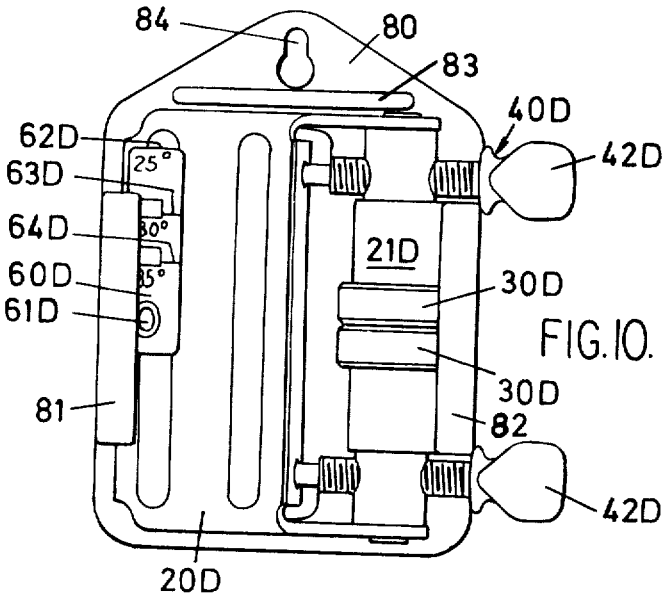
FIGS. 10, 11 and 12 are a plan view, a front elevation view and a side elevation view of a fourth embodiment stored away on a bracket.
Figure 11:
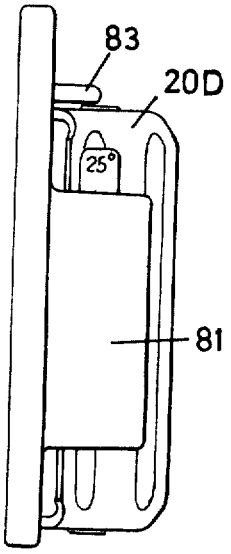

The first, fourth and fifth embodiments each have a gauge in the form of a flexible strip 60 indicating at 62, 63 and 64 the required position of the edge 51 of the blade 50 for the blade 50 to be at respective angles of 25°, 30° and 35° to the abrasive surface. In FIGS. 10 and 11, the strip 60D is shown pivoted round to a storage position. In the first and fourth embodiments, strip 60 is riveted at 61 to the frame 20. In the fifth embodiment, strip 60E is pivoted at 61E to frame 20E and can be stored in a folded position as at 60E.

The second embodiment has written instructions 65 serving the same purpose as the strip 60.

In each embodiment, the angle $\theta$ (see FIG. 16) of the blade 50 relative to the frame 20 is determined by a reference or blade locating surface 24 (see FIG. 7) of the front plate 22 and is independent of the thickness of the blade 50.

Figure 12:
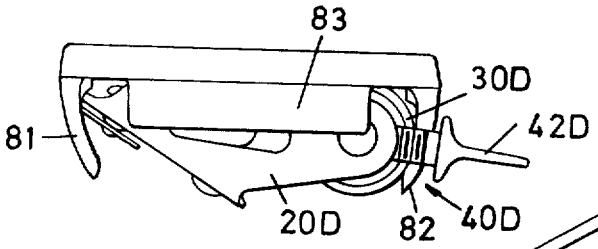

The bracket 80 of FIGS. 10 to 12 has projections 81, 82 and 83 for holding the holder 20D when the latter is to be stored away. The bracket 80 also has a hole 84 for hanging it up.

Figure 14:
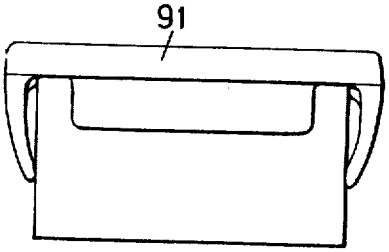
FIG. 14 is a front elevation of the abrasive block and member alone of FIG. 13.
Figure 15:
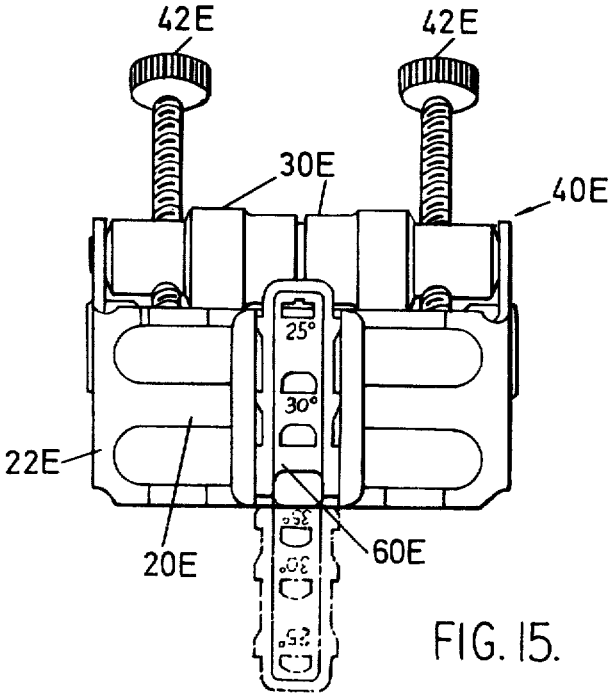
FIGS. 15, 16 and 17 comprise respectively a plan view, a side elevation and an underneath plan view of a fifth embodiment, which is the preferred embodiment.

In FIGS. 13 and 14, blade 50 is shown being honed on an abrasive surface 90 with the holder running on the separate member 91 placed over the abrasive surface 90, after the blade has been sharpened with the holder running directly on the abrasive surface. The effect of member 91 is thus to make the angle less acute between the blade and the abrasive surface, without altering the position of the blade in the holder.

In the fifth embodiment, there is an angle $\theta$ between the side slots 23E and the screws 42E as seen in side elevation, (FIG. 16), so that adjustment of screws 42E is accompanied by pivoting of shaft 21E.

It will be obvious that a number of features are interchangeable between the various embodiments, for example, the number and size of the rollers, the number of screws, the manner of connection of the screw(s) to the wedge member, the gauge or written instructions and the bracket for storing the holder away.

Each of the described and illustrated embodiments is a blade holder adapted to hold the blade (such as blade 50 in FIG. 4) at an acute angle to the abrasive surface, either to grind flat an underneath face 50'' over the whole of the thickness of the blade or, with the blade projecting less far from the holder, to hone a sharp edge (51 in FIG. 4) between a "front" face 50' of the blade and the very edge of the relatively narrow "underneath" face 50'' of the blade. In each embodiment, the clamp is adapted to press the front face of the blade, (that is, the upper face of the blade in FIG. 4,) firmly against a locating surface formed by the front plate 22, so that the position of the front face of the blade is entirely independent of the thickness of the blade. It is this predetermined positioning of the plane of the front face of the blade that enables the use of the gauge to define the blade angle in terms only of the length of the portion of the blade projecting from the frame 20, irrespective of the thickness of the blade and irrespective of whether or not the blade has parallel faces.

I claim:

1. In a blade holder for holding a blade at an acute angle to an abrasive surface for sharpening and honing a ground surface of the blade comprising a frame member having a substantially planar blade locating portion with a front edge beyond which the blade extends and an integral roller mounting portion projecting from said locating portion in fixed relationship thereto, at least one roller mounted on the mounting portion for rotation about an axis extending parallel to the plane of said locating portion, and a movable clamp mounted on the frame for clamping the blade against said locating portion, the combination wherein the blade locating portion of the frame is disposed at an acute angle to the plane defined by said front edge and said axis and is provided with a blade locating surface facing generally toward said axis in fixed relationship to said roller, and said movable clamp is mounted on the frame in confronting relationship with said fixed blade locating surface for movement toward and away from said locating surface in a direction defined by the axis of the roller and the front edge for clamping a blade therebetween with the face of the blade opposite said ground surface being in intimate engagement with said planar blade locating surface whereby the angle defined by the ground surface and opposite face of the blade is independent of the thickness of the blade and dependent on the length of said opposite face projecting from the blade locating portion of the frame beyond said front edge.

2. A blade holder as claimed in claim 1 wherein there are two rollers.

3. A blade holder as claimed in claim 2, wherein the holder comprises means for maintaining the rollers selectively either together or apart.

4. A blade holder as claimed in claim 2, wherein the clamp comprises a wedge member slidably mounted in guides forming part of the frame and at least one screw operatively connected to said wedge member, a shaft mounted on the frame, said two rollers being rotatably mounted on said shaft for rotation about said axis, said at least one screw extending through at least one respective screw-threaded hole in said shaft, transversely of said axis, and further comprising a gauge pivoted to said frame for pivoting between an operative position and a storage position, the gauge indicating at least one required position of the blade relative to the frame for at least one respective given angle of the blade.

5. A blade holder as claimed in claim 1 wherein the frame includes clamp guides and the clamp comprises a member slidably mounted in the guides and at least one screw operatively connected to said slidably mounted member.

6. A blade holder as claimed in claim 5 including a shaft on the frame for rotatably mounting the roller for rotation about said axis, said shaft having at least one screw-threaded hole transversely of said axis and said screw extends through said threaded hole.

7. A blade holder as claimed in claim 1, and further comprising a gauge mounted on said frame indicating at least one required position of the blade relative to the frame for at least one respective given angle of the blade.

* * * * *